US005261537A

United States Patent [19]

Shindo et al.

[11] Patent Number: 5,261,537

[45] Date of Patent: Nov. 16, 1993

[54] CONTAINER

[75] Inventors: Nobuaki Shindo, Tokyo; Seiji Naruse, Kimitsu; Fumiaki Maeda, Kashiwa; Yuujirou Miyamoto, Chiba; Toshio Takeuchi, Funabashi, all of Japan

[73] Assignee: Lion Corporation, Tokyo, Japan

[21] Appl. No.: 697,525

[22] Filed: Apr. 29, 1991

Related U.S. Application Data

[63] Continuation of Ser. No. 517,525, Apr. 27, 1990, abandoned, which is a continuation of Ser. No. 271,087, Nov. 21, 1988, abandoned.

[30] Foreign Application Priority Data

Nov. 20, 1987 [JP] Japan ..... 62-177136[U]

[51] Int. Cl.[5] ..... B65D 21/02

[52] U.S. Cl. ..... 206/518; 206/519; 206/520; 220/23.86; 220/410

[58] Field of Search ..... 206/518, 519, 520; 229/915, 919; 220/23.86, 410

[56] References Cited

U.S. PATENT DOCUMENTS

| | | | |
|---|---|---|---|
| 2,767,755 | 10/1956 | Hill | 206/518 |
| 3,074,547 | 11/1963 | Leukoff | 206/557 |
| 3,119,540 | 1/1964 | Schenk | 229/2.5 |
| 3,237,803 | 3/1966 | Edwards | 206/520 |
| 4,082,184 | 4/1978 | Hammer | 206/520 |
| 4,351,448 | 9/1982 | Ingersoll | 220/91 |

FOREIGN PATENT DOCUMENTS

| | | | |
|---|---|---|---|
| 2624301 | 12/1977 | Fed. Rep. of Germany | 206/520 |
| 1490636 | 6/1967 | France | 206/519 |
| 606836 | 7/1960 | Italy | 206/520 |
| 64511 | 2/1941 | Norway | 206/520 |
| 631678 | 11/1961 | United Kingdom | 220/91 |

*Primary Examiner*—Joseph M. Moy
*Attorney, Agent, or Firm*—Darby & Darby

[57] ABSTRACT

A container used for containing powders such as a washing powder and the like has bottom stopper means for fixedly supporting another container when another container is inserted into the container. When a lot of containers are stored before containing contents therein, many can be stacked on top of one another. With these containers, the space needed for storing can be reduced.

11 Claims, 5 Drawing Sheets

CONTAINER

This is a continuation of application Ser. No. 517,525, filed Apr. 27, 1990 now abandoned, which is a continuation of application Ser. No. 271,087, filed Nov. 21, 1988 now abandoned.

BACKGROUND OF THE INVENTION

1. Field of the Invention

The present invention relates to a container for containing powders such as a washing powder and the like therein.

2. Discussion of Related Art

FIGS. 10 and 11 show a container disclosed in Utility Model Application 62-120,792 which has been filed by the present inventors. The container comprises a main body 1 having an approximately rectangular parallelepiped shape and having a rectangular shaped opening 2 at an upper portion thereof, and a lid member (not shown) for covering the opening 2 and the upper portion of the main body 1.

The main body 1, called the pillar-carton, comprises a blank sheet 3 for constructing four end walls and four side corners of the main body 1 and a frame member 4 for preventing the main body 1 from deformation.

The blank sheet 3 comprises a main sheet of paper materials and a coating layer of varnishes formed on one of the surfaces of the main sheet.

The frame member 4, which is made of synthetic resins such as polypropylene and the like, comprises a rectangular tray shaped lower portion or tray 5, including a bottom portion 5*a* having a rectangular shape, a pair of first side walls 5*b* of low height disposed at longitudinal edges of the bottom portion 5*a* and a pair of second side walls 5*c* of low height disposed at transverse edges thereof, a rectangular frame shaped upper portion or a frame 6 including a pair of longitudinal end walls 6*a* and a pair of transverse end walls 6*b*, and a pair of pillars 7 for connecting central portions of the second side walls 5*c* of the tray 5 to central portions of the transverse end walls 6*b* of the frame 6 so as to be assembled the upper portion just above the tray 5 at a predetermined interval as shown in FIG. 11. A peripheral projection 8 is formed outward peripherally at outer surfaces of the longitudinal and transverse end walls 6*a* and 6*b* of the frame 6. The peripheral projection 8 is a portion for engaging with a groove formed at an inner peripheral wall of the lid member when the main body 1 is covered with the lid member. Also, a pair of rivets 9 used for putting a handle member (not shown) to the main body 1 are disposed at portions beneath the peripheral projection 8 on the transverse end walls 6*b*. Each of the rivets 9 has a approximately T-shaped cross section and has a circular plate formed at a top portion thereof. In the frame member 4, a plan-view geometry of the bottom portion 5*a* of the tray 5 is not greater than that of the frame 6.

The frame member 4 is surrounded with the blank sheet 3 so as to cover a space defined by the tray 5 and the frame 6 and the pillars 7 therewith to thereby be assembled into the main body 1. Specifically, a pair of the transverse marginal portions of the coating layer of the blank sheet 3 are pasted up on one of the pillars 7 so that the marginal portions face each other. A pair of the longitudinal marginal portions of the coating layer of the blank sheet 3 are peripherally pasted up on the first and second side walls 5*b* and 5*c* of the tray 5 and on the longitudinal and transverse end walls 6*a* and 6*b* of the frame 6.

When the main body 1 is manufactured, the blank sheet 3 is pasted up on the side portion of the frame member 4 while the frame member 4 is molded by injection molding. In this case, the blank sheet 3 is put in a mold which can be separated into male and female sections, i.e., with a space defined between the male and female sections and then materials used for making the frame member 4 are injected into the space. Immediately after the injection, the materials are subjected to a molding pressure to be molded thereby to the frame member 4 pasted the blank sheet 3, that is, to obtain the main body. This process has the advantage of manufacturing the main body 1 simply.

With the main body 1 as above described, it is stored until the contents such as washing powders and the like are contained therein. A space for storing the main bodies 1 must be reduced in order to store them efficiently. The main bodies 1 are therefore stacked several bodies high so as to insert a bottom portion of an upper main body, denoted by the character C in FIG. 11, into the opening 2 of the lower main body 1.

After molding of the main body 1, it is cooled to the room temperature. During cooling, the blank sheet 3 and the frame member 4 shrink slightly as their respective temperatures approach room temperature. However, they have different shrinkage coefficients, so that the four side surfaces of the main body 1 become outwardly slightly curved. When the main bodies 1 are stacked, peripheral portions of the curved surfaces of the upper main body 1 come in contact with peripheral edges of the opening 2 of the lower main body 1 to thereby prevent the upper main body 1 from further deeply inserting into the lower. Specifically, the upper main body is unstably hung on the peripheral edges of the opening 2 of the lower. Thus, the main bodies 1 cannot be stacked very highly, usually not more than ten to fifteen bodies high.

SUMMARY OF THE INVENTION

Accordingly, it is an object of the present invention to provide a container having one main body which can be stably stacked upon other main bodies when required.

Accordingly, in the present invention, there is provided a container comprising:

(a) at least one side wall having an upper end and a lower end, the at least one side wall defining an inner surface thereby between the upper end and the lower end for containing contents therein, the cross sectional area of the inner surface increasing from the lower end to the upper end;

(b) a bottom plate attached to the lower end of the side wall for closing a lower end of the inner surface; and (c) bottom stopper means disposed on an inner surface of the side wall so that, when a first container is inserted in a second container, bottom portion of the first container comes in contact with the bottom stopper means of the second container simultaneously as an outer surface of the side wall of the first container comes in contact with the upper end of the side wall of the second container, whereby fixedly supporting the first container by the upper end of the side wall and the bottom stopper means of the second container.

BRIEF DESCRIPTION OF THE DRAWINGS

The present invention will now be described with reference to the accompanying drawings wherein.

DESCRIPTION OF PREFERRED EMBODIMENTS OF THE INVENTION

Figure 10:
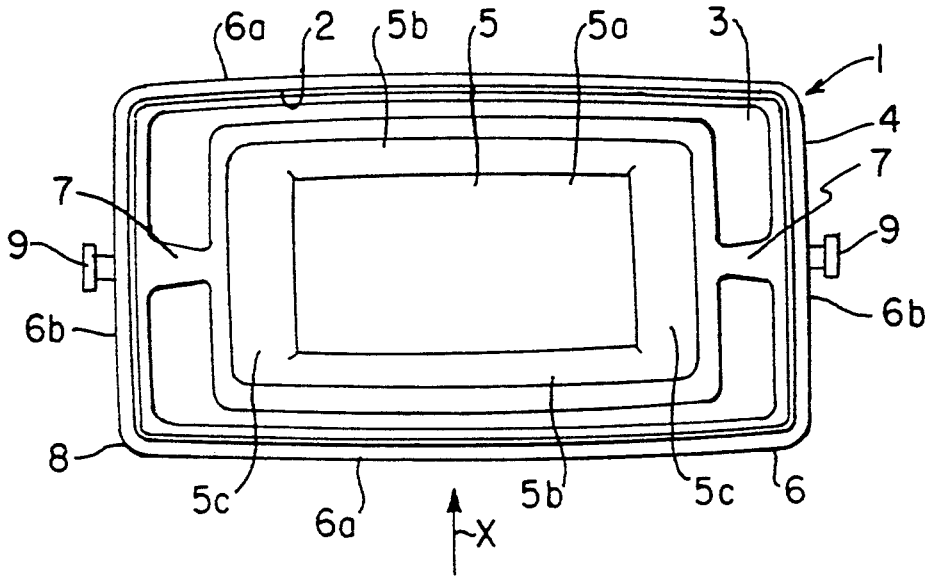
FIG. 10 is a diagrammatic plan view showing a main body of a conventional container.
Figure 11:
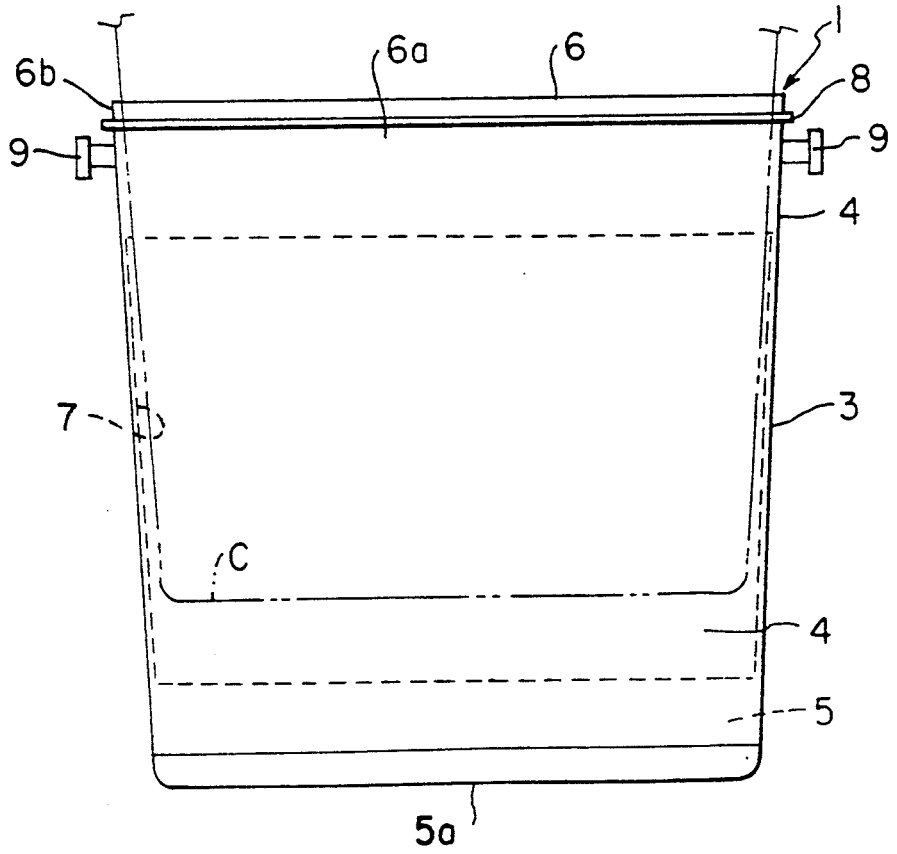
FIG. 11 is a view in the direction of the arrow X in FIG. 10.

In FIGS. 1 to 6, components and parts corresponding to those shown in FIGS. 10 and 11 are designated by the same reference numerals, and therefore the description of the corresponding components and parts are omitted to avoid repetitions of the same description.

FIGS. 1 to 6 illustrate a container or a preferred embodiment of the present invention. The container comprises a main body 20 including the blank sheet 3, the frame member 4 surrounded with the blank sheet 3, a lid member (not shown) for covering the rectangular shaped opening 2 and the upper portion of the main body 20, and a handle member 30 for lifting up the main body 20.

As for the frame member 4 of the main body 20, a recess 40 is formed in the tray 5 along a periphery of the bottom surface of the tray 5 so that the recess 40 opens to both the bottom and peripheral surfaces thereof. The recess 40 is defined by a lower surface 41 peripherally formed at the peripheral edge of the bottom surface of the tray 5 so as to face to outward and an upper surface 42 peripherally formed at the lower peripheral edge of the peripheral surface thereof so as to face downward. The edge defined by the bottom surface of the tray 5 and the lower surface 41 of the recess 40 is rounded. Equally, the edge defined by the peripheral surface of the tray 5 and the upper surface 42 of the recess 40 is rounded.

Figure 1:
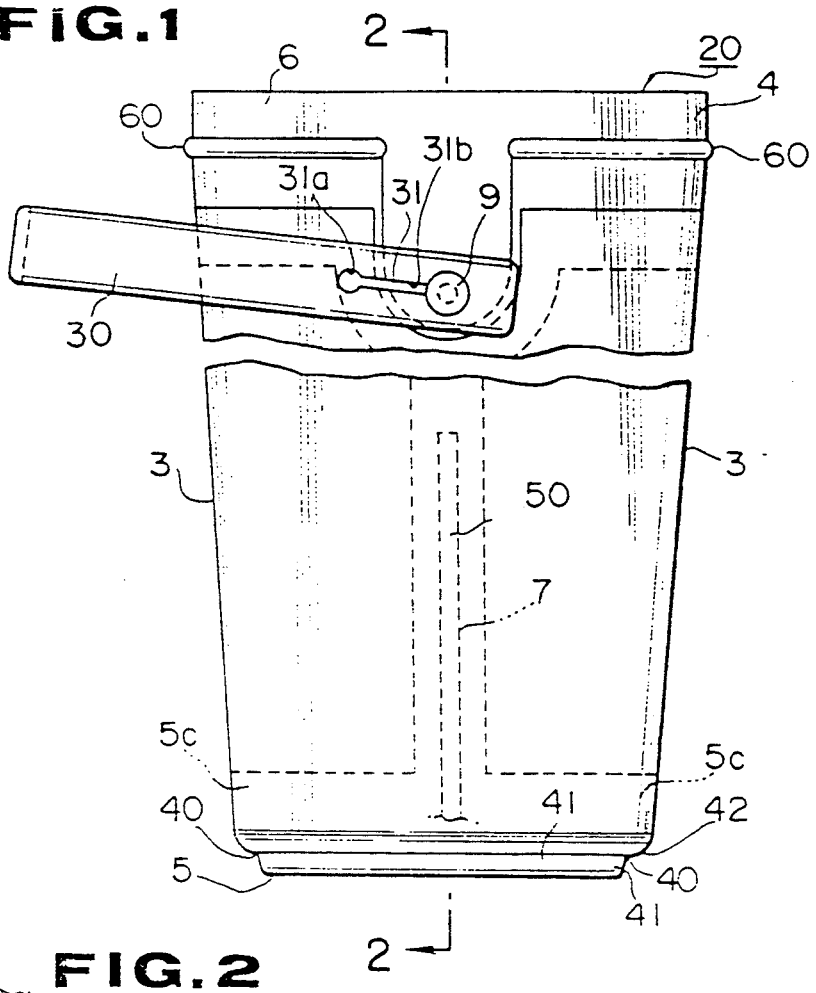
FIG. 1 is a side view showing a preferred embodiment of the present invention.
Figure 2:
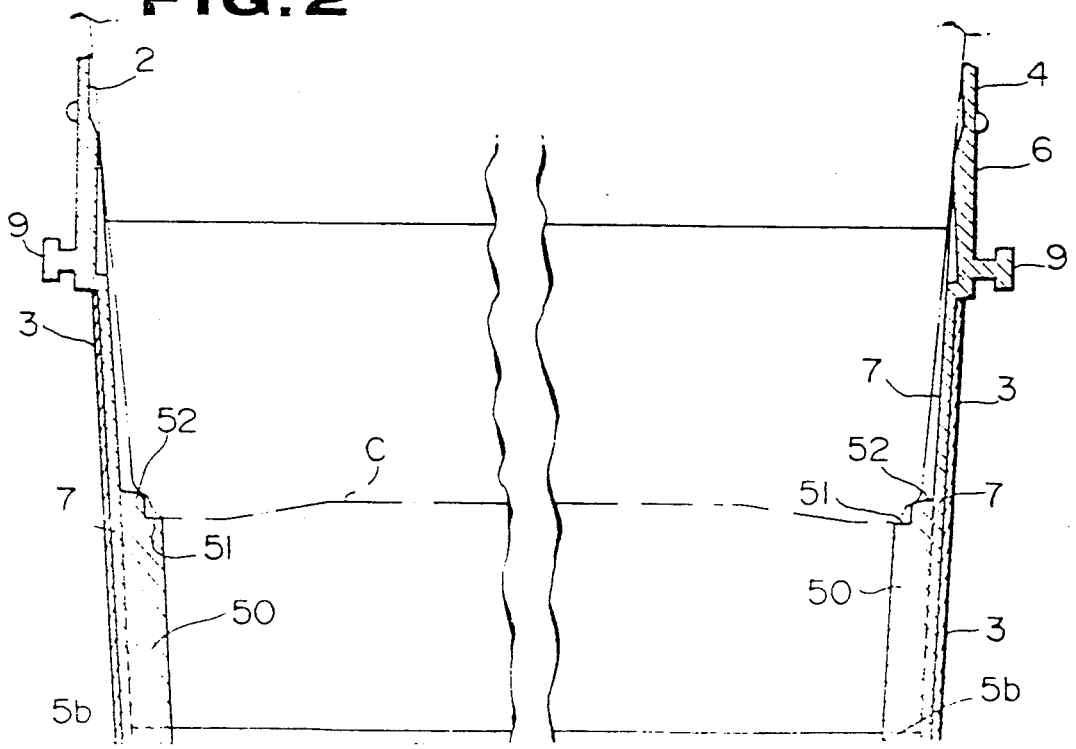
FIG. 2 is a sectional view taken along the plane 2—2 of FIG. 1 showing the preferred embodiment of the present invention.
Figure 3:
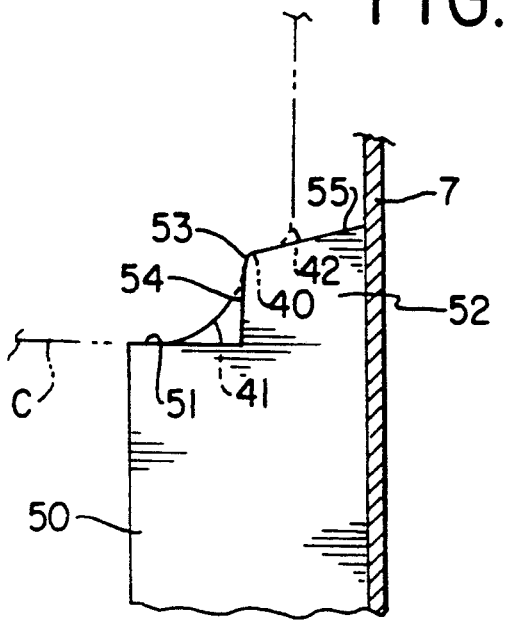
FIG. 3 is a sectional view showing a stacking rib of the frame member of the preferred embodiment of the present invention.
Figure 4:
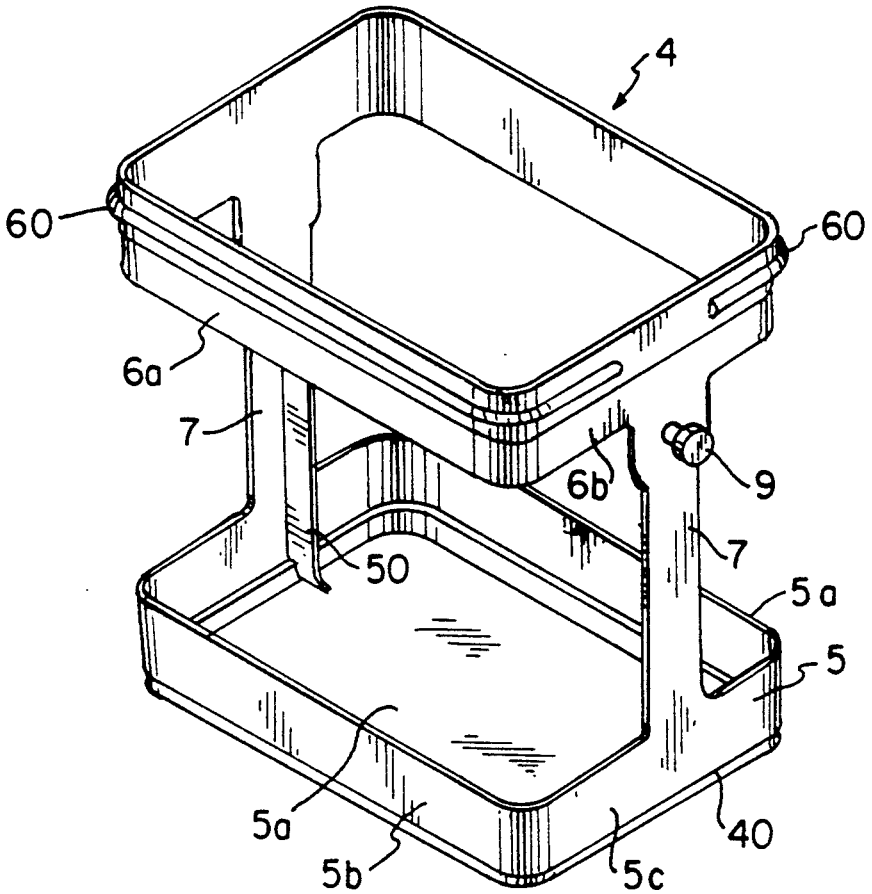
FIG. 4 is a perspective view showing a frame member suitable used as an assembly of the preferred embodiment of the present invention.

In the frame member 4, each of the pillars 7 has a stacking rib 50 inward disposed at inner surfaces thereof. The stacking rib 50 has an approximately rectangular shape and extends from the bottom surface of the tray 5 to an approximately central portion of the pillars 7 in a predetermined height as shown in FIGS. 1 to 3. The stacking rib 50 has a plain surface 51 facing upwards formed on an upper portion thereof. When a first main body denoted by the character C as shown in FIGS. 2 and 3 having the same geometries as a second main body 20 is inserted into the second main body 20, the plain surface 51 of the second main body 20 comes into contact with the bottom surface of the first main body C simultaneously as an outer surface of the peripheral wall of the first main body C comes into contact with a peripheral edge of the opening 2 of the second main body 20.

A shoulder portion 52 is formed above and adjacent to the plain surface 51. Specifically, the shoulder portion 52 has a corner 53 defined by an approximately vertically inclined surface 54 formed at a central portion of the plain surface 51 so as to be at an approximately right angle to the plain surface 51 and a slope 55 upward outward formed at an upper edge of the approximately vertical surface 54 so as to extend to the inner surface of the pillar 7. When the first main body C is inserted into the second main body 20, the corner 53 of the second main body 20 engages with the recess 40 of the first main body C simultaneously as the outer surface of the peripheral wall of the first main body C comes into contact with the peripheral edge of the opening 2 of the second main body 20. Specifically, the slope 55 of the second main body 20 comes into contact with the upper surface 42 of the recess 40 of the first main body C. Also, the approximately vertical surface 54 of the second main body 20 comes into contact with the lower surface 41 of the recess 40 of the first main body C so as to prevent the first main body C from swinging.

Thus, the first main body C can be fixedly supported by both the said plain surface 51 and the shoulder portion 52 of the stacking rib 50 of the second main body 20 as the bottom stopper means in cooperation with the opening 2 of the second main body 20.

Also, each of the pillars 7 has a rivet 9 outwardly disposed at an upper portion thereof. The rivet 9 has a mechanical strength sufficient to hold out against pressure caused by the total weight including weight of the container and that of contents contained in the container because the rivets 9 are disposed at the pillars 7 of the frame member 4. The rivets 9 may be formed on the pillars 7 in one step of an injection molding for manufacturing the frame member 4.

As shown in FIG. 1, opposite ends of the handle member 30 of flexible materials are rotatably connected to the rivets 9 formed at the frame member 4. The handle member 30 has a pair of linear apertures 31 formed at the opposite ends thereof so that the linear apertures 31 extend in a longitudinal direction of the handle member 30. Each of the linear apertures 31 comprises a pair of arched edges 31*a* and a pair of linear edges 31*b* paralleled to each other and defined between the arched edges 31*a*. An interval between the linear edges 31*b* is determined on the basis of a diameter of a root portion of the rivet 9 so as to pass it smoothly therebetween. An inner diameter of each arched edge 31*a* is determined on the basis of an outer diameter of the circular plate of the rivet 9 so as not to allow it to pass therethrough. A process for connecting the handle member 30 to the rivets 9 formed at the frame member 4 includes a step of spreading out the linear aperture 31 in a transverse direction of the linear aperture 31 and a step of inserting the circular plate of the rivet 9 into the linear aperture 31 spread out.

In the frame member 4, a pair of peripheral projections 60 each having a semicircular cross section are outwardly peripherally disposed on outer surfaces of the longitudinal and transverse end walls 6a and 6b of the frame 6 except on two central portions of the transverse end walls 6b, so that opposite ends of the peripheral projections 60 face each other at a predetermined interval in the central portions of the transverse end walls 6b. The peripheral projection 60 is a portion for engaging with a groove formed in an inner peripheral wall of a lid member (not shown) when the main body 20 is covered with the lid member. Also, each of the spaces defined between the ends of the peripheral projections 60 is positioned just above the rivet 9.

Figure 5:
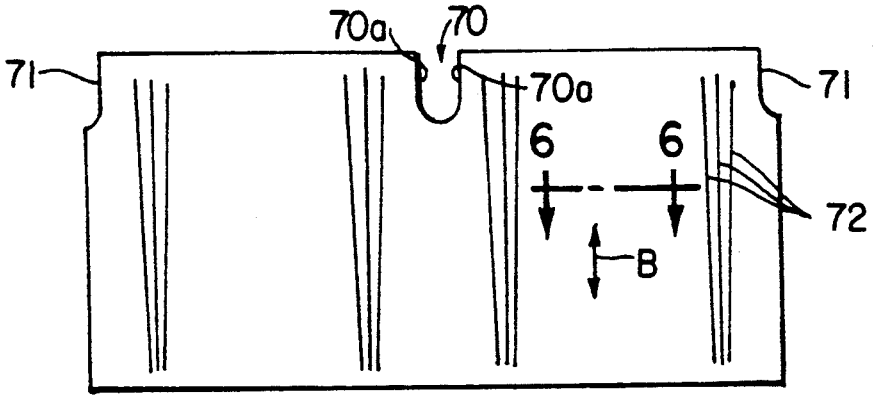
FIG. 5 is a diagrammatic plan view showing a blank sheet of the preferred embodiment of the present invention.
Figure 6:
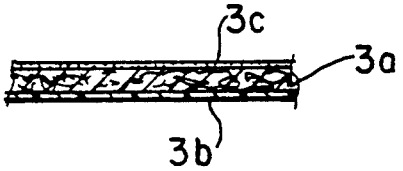
FIG. 6 is a sectional view taken along the plane VI—VI of FIG. 5.

As for the blank sheet 3 of the main body 20, it has an approximately rectangular shape and comprises a main sheet 3a made of paper materials, a film 3b made of synthetic resins superimposed on one surface of the main sheet 3a and a coating layer 3c of varnishes formed on the other surface of the main sheet 3a as shown in FIGS. 5 and 6. An advertisement can be printed on the film 3b of the blank sheet 3. A first notch 70 is formed at a central portion of a longitudinal marginal portion of the blank sheet 3 and comprises a pair of opposite edges 70a each extending in a transverse direction along the blank sheet 3 and an arched edge 70b defined between the opposite edges 70a. Also, a pair of second notches 71 are formed at a pair of corners defined at ends of the longitudinal marginal portion having the first notch 70, respectively. Each of the second notches 71 has the identical plan-view geometry as a half of the first notch 70 which is taken along an image line defined in the transverse direction of the blank sheet 3 when passing through a central point of the arched edge 70b. The first and second notches 70 and 71 serve to avoid the rivets 9 when the frame member 4 is surrounded with the blank sheet 3 so as to cover a space defined by the tray 5, the frame 6 and the pillars 7. A machine direction of the main sheet 3a of the blank sheet 3 substantially parallels a direction of ridgelines defined by the side corners of the main body 20 or a direction denoted by the arrow B as shown in FIG. 5. The length of the longitudinal edges of the blank sheet 3 are determined on the basis of the peripheral length of the frame member 4. Also, the width of the transverse edges of the blank sheet 3 are determined on the basis of the height of the frame member 4. Four bundles of lines 72 at which the blank sheet 3 can be easily bent when the side corners of the main body 20 are formed are disposed at portions of one surface of the blank sheet 3 in accordance with the side corners to be formed, each of the lines 72 extending approximately in the machine direction of the blank sheet 3, i.e., in the transverse direction thereof. One bundle of the lines 72 includes three lines in the embodiment of the present invention. Intervals among the three lines 72 in one bundle are continuously reduced as the lines 72 close toward the longitudinal edge having no notches.

Figure 7:
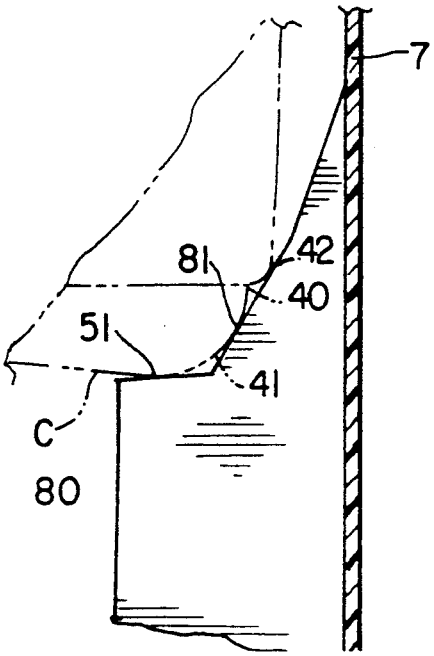
FIG. 7 is a sectional view showing a stacking rib of the frame member of another preferred embodiment of the present invention.

FIG. 7 illustrates another preferred embodiment of the present invention. In this embodiment, each of the stacking ribs 80 as the bottom stopper means includes the plain surface 51 and a slant 81 upward steeply disposed at the outer end of the plain surface 51 so as to extend to the inner surface of the pillar 7. When the first main body C is inserted into the second main body 20, the plain surface 51 of the second main body 20 comes in contact with the bottom of the first main body C and the slant 81 of the second main body 20 comes in contact with the lower surface 41 of the recess 40 of the first main body C. Thus, the first main body C can be fixedly supported by the stacking ribs 80 of the second main body 20.

Figure 8:
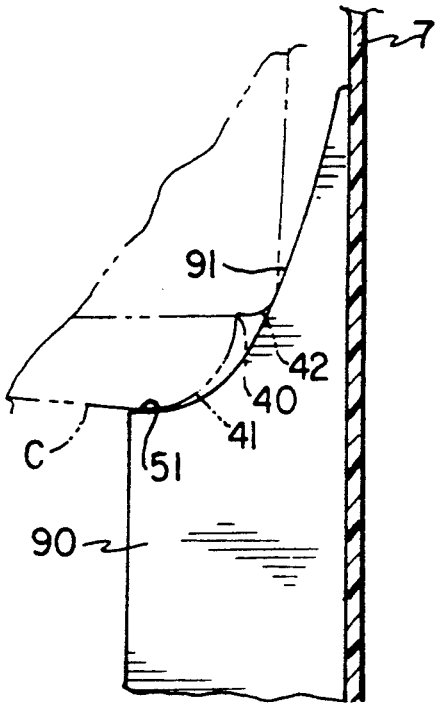
FIG. 8 is a sectional view showing a stacking rib of the frame member of further preferred embodiment of the present invention.

FIG. 8 illustrates yet another preferred embodiment of the present invention. In this embodiment, each of the stacking ribs 90 includes the plain surface 51 and a curved slant 91 upwardly and outwardly disposed at the outer end of the plain surface 51 so as to extend to the inner surface of the pillar 7. When the first main body C is inserted into the second main body 20, the plain surface 51 of the second main body 20 comes in contact with the bottom of the first main body C and the curved slant 91 of the second main body 20 comes in contact with the upper surface 42 of the recess 40 of the first main body C. Thus, the first main body C can be fixedly supported by the stacking ribs 90 of the second main body 20.

Figure 9:
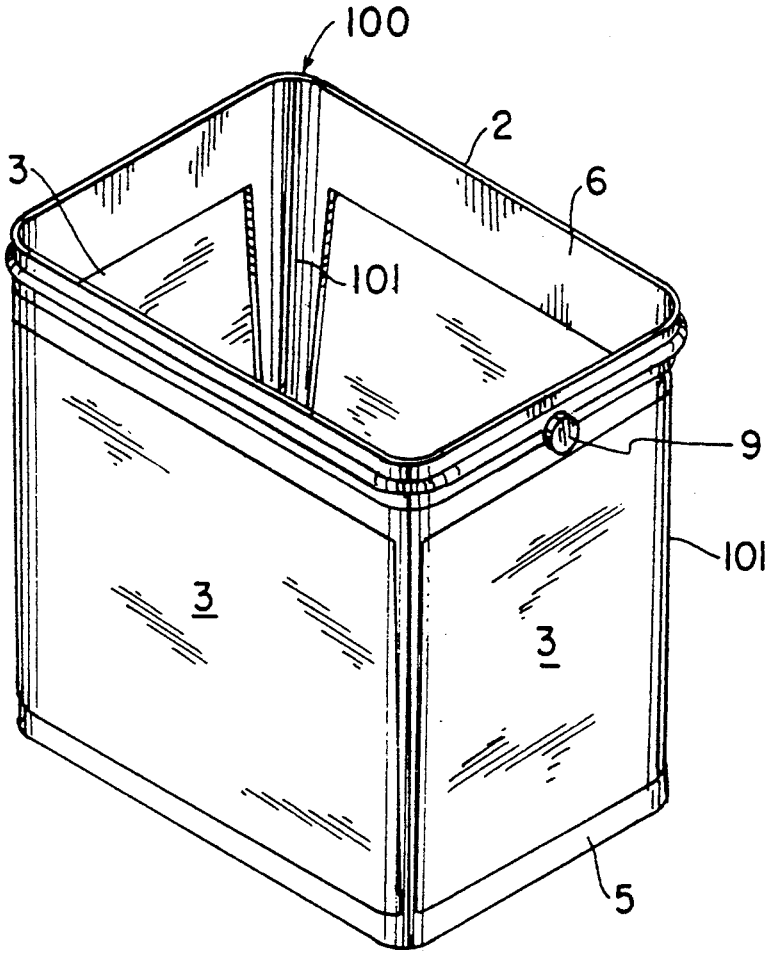
FIG. 9 is a perspective view showing a frame member of yet another preferred embodiment of the present invention, the frame member having four pillars.

FIG. 9 illustrates another preferred embodiment of the present invention. In this embodiment, the frame member 100 has four pillars 101, each of the pillars 101 connecting one of corners of the tray 5 to one of corners of the frame 6. The container including the frame member 100 has the advantage of using not only the longitudinal side walls of the main body 20 but also the transverse side walls thereof as a space for advertisement. Also, each of the transverse side walls 6b of the frame 6 has a rivet 9 formed at a central portion thereof. In this embodiment, each of the pillars 101 has a stacking rib (not shown) as bottom stopper means formed at an inner surface thereof.

It should be noted that, although the main body 20 has the approximately rectangular parallelepiped shape as above described, it may have a cylindrical shape, a polygonal shape or the like.

What is claimed is:

1. A container comprising a body including:

(a) a frame member having:

(i) an upper side wall including four parts, each part having an approximately rectangular shape which joins to form a closed loop and having an upper end and a lower end, (ii) a lower side wall including four parts, each part having an approximately rectangular shape which join to form a closed loop and having an upper end and a lower end, said lower side wall having a bottom plate attached to the lower end thereof, the cross sectional area of the closed loop formed by said lower side wall being smaller than that of said upper side wall, and (iii) at least one pair of pillars connecting said upper side wall to said lower side wall at a predetermined interval;

(b) a blank sheet for covering at least two surfaces defined by said upper side wall, said lower side wall and said pillars of said frame member; and (c) stacking ribs disposed on an inner surface of said pillars so that, when an identical container is inserted into said body, a portion of the bottom of said identical container comes in contact with an upper surface of said stacking ribs of said body simultaneously as an outer surface of said identical container comes in contact with an upper end of said frame member of said body.

2. A container comprising a body which includes:

(a) a frame member having:

(i) an upper side wall including four parts, each part having an approximately rectangular shape which joins to form a closed loop and having an upper end and a lower end, (ii) a lower side wall including four parts, each part having an approximately rectangular shape which join to form a closed loop and having an upper end and a lower end, said lower side wall having a bottom plate attached to the lower end thereof, the cross sectional area of the closed loop formed by said lower side wall being smaller than that of said upper side wall, and (iii) at least one pair of pillars connecting said upper said wall to said lower side wall at a predetermined interval;

(b) a blank sheet for covering at least two surfaces defined by said upper side wall, said lower side wall, and said pillars of said frame member;

(c) stacking ribs being inwardly disposed on an inner surface of said pillars and extending upwardly from said bottom plate to the position in which, when an identical container is inserted into said body, a portion of the bottom of said identical container comes in contact with an upper surface of said stacking ribs of said body simultaneously as an outer surface of said identical container comes in contact with an upper end of said frame member of said body; and (d) means for securing a handle at upper portions of said pillars.

3. A container according to claim 2, wherein each of said stacking ribs has an upper end portion, the upper end portion having:

(i) a lower contact point on which a lowermost surface of the bottom portion of said identical container comes into contact when said identical container is inserted in said body, and (ii) an upper contact point on which a side surface of the bottom portion of said identical container comes into contact when said identical container is inserted in said body.

4. A container according to claim 3, wherein each of said stacking ribs includes a planar surface formed at said upper end portion thereof and which is parallel to a surface of said bottom portion of said lower side wall, and also includes a shoulder portion having a corner defined by a raised surface upwardly disposed at said planar surface so as to be at approximately a right angle with said planar surface and a sloped portion which slopes upwardly and outwardly disposed at an upper edge of said raised surface so as to extend to the inner surface of said pillar; and said lower contact point is disposed on said planar surface, and said upper contact point is disposed on said shoulder portion.

5. A container according to claim 3, wherein said stacking rib includes a planar surface formed at said upper end portion thereof and which is parallel to a surface of said bottom portion of said lower side wall, and also includes a slanting portion disposed at said planar surface so as to extend to the inner surface of said pillar, said lower contact point being disposed on said planar surface, said upper contact point being disposed on said slanting portion.

6. A container according to claim 2, wherein said securing means includes a projection extending from an outer surface area of said body, and a handle being pivotally connected to said projection.

7. A container comprising a body which includes:

(a) a frame member having:

(i) an upper side wall including four parts, each part having an approximately rectangular shape which joins to form a closed loop and having an upper end and a lower end, (ii) a lower side wall including four parts, each part having an approximately rectangular shape which join to form a closed loop and having an upper end and a lower end, said lower side wall having a bottom plate attached to the lower end thereof, the cross sectional area of the closed loop formed by said lower side wall being smaller than that of said upper side wall, and (iii) at least one pair of pillars connecting said upper said wall to said lower side at a predetermined interval;

(b) a blank sheet for covering at least two surfaces defined by said upper side wall, said lower side wall and said pillars of said frame member;

(c) stacking ribs being inwardly disposed on an inner surface of said pillars and extending upwardly from said bottom plates to the position in which, when an identical container is inserted into said body, a portion of the bottom of said identical container comes in contact with an upper surface of said stacking ribs of said body simultaneously as an outer surface of said identical container comes in contact with an upper end of said frame member of said body; and (d) means for securing a handle at portions of said upper side wall where each of said pillars is connected.

8. A container according to claim 7, wherein said securing means includes a projection extending from an outer surface area of said body, and a handle being pivotally connected to said projection.

9. A container according to claim 7, wherein each of said stacking ribs has an upper end portion, the upper end portion having:

(i) a lower contact point on which a lowermost surface of the bottom portion of said identical container comes into contact when said identical container is inserted in said body, and (ii) an upper contact point on which a side surface of the bottom portion of said identical container comes into contact when said identical container is inserted in said body.

10. A container according to claim 9, wherein each of said stacking ribs includes a planar surface formed at said upper end portion thereof and which is parallel to a surface of said bottom portion of said lower side wall, and also includes a shoulder portion having a corner defined by a raised surface upwardly disposed at said planar surface so as to form an approximate right angle with said planar surface, and a sloped portion which slopes upwardly and outwardly disposed at an upper edge of said raised surface so as to extend to the inner surface of said pillar, said lower contact point being disposed on said planar surface, and said upper contact point being disposed on said shoulder portion.

11. A container according to claim 9, wherein said stacking rib includes a planar surface formed at said upper end portion thereof which is parallel to a surface of said bottom portion of said lower side wall, and also includes a slanting portion disposed at said planar surface so as to extend to the inner surface of said pillar, said lower contact point being disposed on said planar surface, said upper contact point being disposed on said slanting portion.

* * * * *